United States Patent [19]

Cardin

[11] 4,231,010

[45] Oct. 28, 1980

[54] THERMOSTATIC SWITCH EMPLOYING A STUD MEMBER FOR CALIBRATION OF THE SWITCH

[75] Inventor: Wilfred W. Cardin, Attleboro, Mass.

[73] Assignee: Texas Instruments Incorporated, Dallas, Tex.

[21] Appl. No.: 965,447

[22] Filed: Nov. 30, 1978

[51] Int. Cl.[3] ..... H01H 61/01

[52] U.S. Cl. ..... 337/94; 337/82; 337/360

[58] Field of Search ..... 337/93, 94, 86, 82, 337/360, 57, 347, 368; 85/151; 151/41.73

[56] References Cited

U.S. PATENT DOCUMENTS

| | | | |
|---|---|---|---|
| 3,418,869 | 12/1968 | Herpich | 151/41.73 |
| 3,452,313 | 6/1969 | Perry | 337/86 |
| 3,456,972 | 7/1969 | Drotar | 151/41.73 |

*Primary Examiner*—Harold Broome
*Attorney, Agent, or Firm*—James P. McAndrews

[57] ABSTRACT

A thermostatic switch has a thermostatic subassembly located on a header so that movable contacts engage and disengage complementary contacts mounted on the header in response to temperature change. A knurled stud part has an interference fit in a header bore and a nut threadedly engages the opposite end of the stud means and bears against the opposite side of the header. The nut is rotatable for drawing the knurled stud part into the header bore to the desired degree to precisely locate the subassembly relative to the header during switch manufacture and calibration. The interference fit of the knurled stud part in the header bore otherwise cooperates with the nut to prevent rotation or axial movement of the stud means in any direction in the header bore.

6 Claims, 4 Drawing Figures

THERMOSTATIC SWITCH EMPLOYING A STUD MEMBER FOR CALIBRATION OF THE SWITCH

A temperature responsive electrical switch having good performance characteristics is shown in U.S. Pat. No. 3,452,313 issued to F. G. Perry on June 24, 1967. In that known switch, a resilient snap-acting thermostatic disc and a heater plate are combined in a subassembly to achieve desired thermal response and arc shielding characteristics. Movable contacts are carried by the heater plate. A support for the subassembly is located on a header by means of a screw member so that, as the thermostatic disc moves in response to selected temperature changes, the movable contacts engage and disengage fixed contacts on the header, thereby to open and close switch circuits in response to the temperature changes. The screw member is threadedly engaged with the header and is rotatably attached to the subassembly support so that the screw member is rotatably adjustable to move the subassembly relative to the header for calibrating the switch. If desired, a lock nut is added to the screw member after calibration to hold the screw member in its position of adjustment.

In that known switch, good temperature response characteristics are achieved and the thermostatic disc is protected against arcing occurring at the contacts so that the switch displays a long service life. The known switch structure also has other desirable features. However the switch calibration system is somewhat expensive and entails some manufacturing and assembly operations which are inconvenient and uneconomical. For example, mounting of the adjusting screw member on the header requires careful tapping of the header. Further, close tolerances are required in several components and careful assembly is required for rotatably attaching the adjusting screw to the subassembly support in order to assure proper temperature response of the switch. In addition, some undesirable wobbling of the subassembly support can occur when the adjusting screw is being rotated during switch calibration. A spring may be required between the support and the header if the switch is to be position-independent, particularly where the rotatable attachment of the screw member to the subassembly support may be too loose; and the two-stage wrenching action required for adding a lock nut is inconvenient to perform when the switch is being calibrated.

It is an object of this invention to provide a novel and improved snap-acting thermostatic electrical switch; to provide such a switch which displays good thermal response characteristics and a long service life; to provide such a switch which is adapted to be economically and conveniently manufactured, assembled and calibrated; and to provide such a switch which is of simple, rugged and reliable construction.

Briefly described, the novel and improved thermostatic switch of this invention preferably comprises a subassembly of a snap-acting thermostatic disc and a heater plate. The heater plate has movable contacts thereon. The switch also includes a header which mounts complementary, fixed contacts. The header has a through-bore therein and a support for the subassembly is mounted on the header by the use of stud means of particular construction which fit into that header bore. The stud means precisely locate the subassembly on the header for calibrating the switch, whereby movement of the thermostatic disc is response to selected temperature changes moves the movable contacts into and out of engagement with the fixed contacts carried by the header.

In the switch of this invention, the stud means comprises a member having one end which is fixedly secured to the subassembly support, preferably by rivet means integrally formed at that end of the stud member. Since the stud is fixed to the support no close tolerances or careful assembly steps are required for connecting the stud to the support. The stud also has a knurled intermediate portion of a selected diameter adapted to be forced part way into the header bore to have an interference fit in the bore. The opposite end of the stud member is threaded and is of relatively lesser diameter than the knurled stud part.

The stud member is inserted into the header bore from one side of the header so that the subassembly support secured to the stud is disposed at that side of the header and so that the threaded end of the stud passes through the bore and extends from the opposite side of the header. A nut threadedly engages that threaded end of the stud and bears against the opposite side of the header. In that arrangement, rotation of the nut draws the knurled stud part way into the header bore to establish an interference fit in the bore and to precisely locate the subassembly support relative to the header. That is, the nut rotation calibrates the switch by disposing the movable contacts carried by the subassembly in a precisely selected location relative to the fixed contacts on the header so that movement of the thermostatic disc in response to selected temperature changes opens and closes the switch circuits at predetermined temperatures. The knurled surface of the intermediate stud part prevents rotation of the stud member in the header bore so that the subassembly is precisely located relative to the header and so that only a single wrenching action is needed for calibrating the switch. The interference fit of the knurled stud part prevents axial movement of the stud member further into the header bore and the nut threadedly engaged with the stud prevents axial movement of the stud in the opposite direction out of the bore. Thus, the switch utilizes economical components and is adapted for convenient, economical and reliable manufacture, assembly and calibration.

Other objects, advantages and details of the novel and improved switch of this invention appear in the following detailed description of preferred embodiments of the invention, the detailed description referring to the drawings in which.

Figure 1:
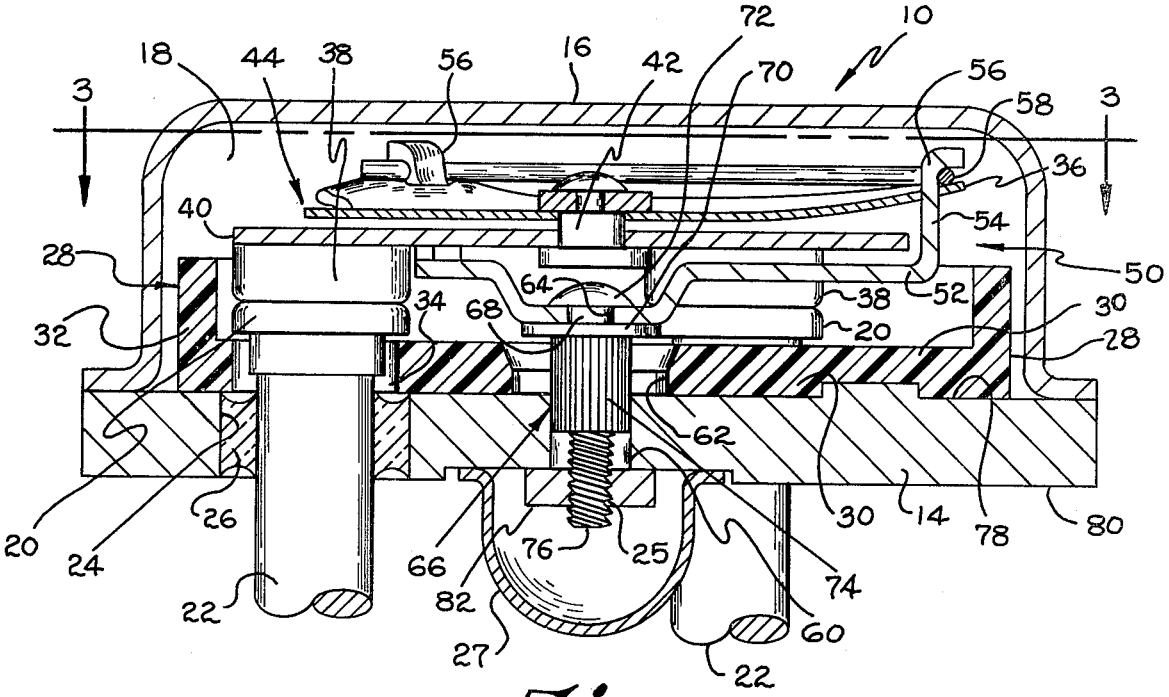
FIG. 1 is a section view along the central axis of the switch of this invention illustrating the switch in closed circuit position.

Referring to the drawings, 10 in FIGS. 1–4 indicates the novel and improved switch of this invention which is shown to include a metal base or header 14. Typically a cover 16 is welded to the header to form an hermetically sealed compartment 18 for enclosing the operating components of the switch. Fixed electrical contacts 20 are mounted on the header. Preferably, for example, three terminals 22 are mounted in respective openings 24 in the header and are sealed and secured in those openings and are electrically insulated from the header by conventional glass seal means 26. The fixed contacts 20 are welded or otherwise mounted on respective terminals 22 inside the compartment 18. If desired, a cup-shaped ceramic insulator 28 having a bottom 30 and a side-wall 32 is mounted on the header by cementing or the like so that openings 34 in the bottom of the insulator fit over the respective terminals 20.

Figure 2:
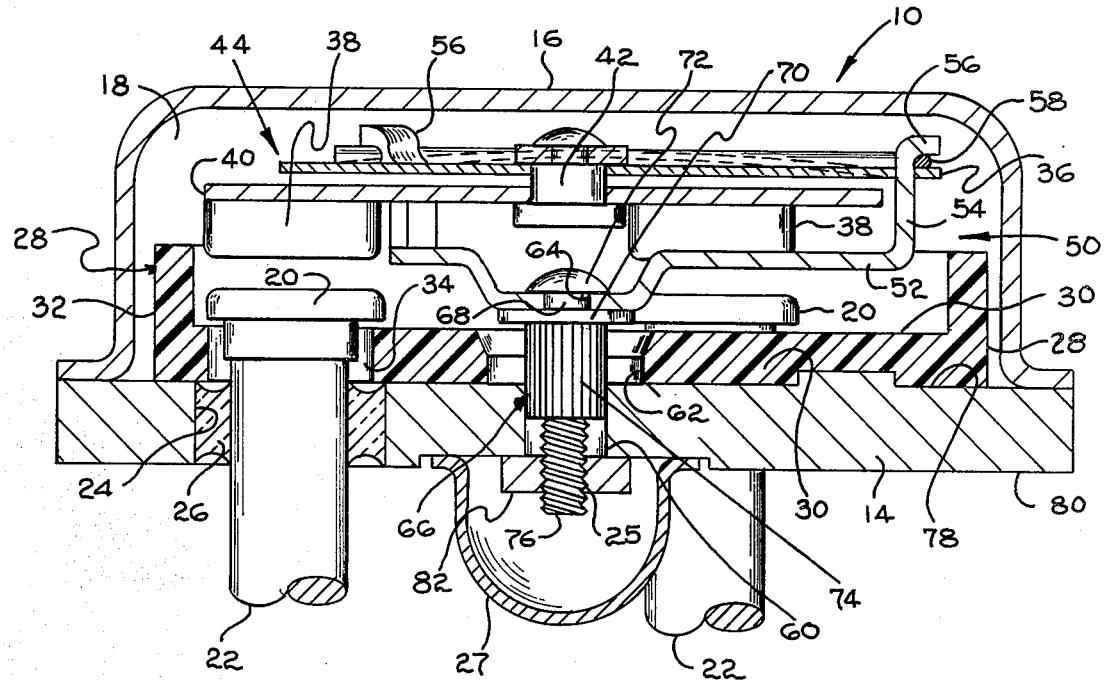
FIG. 2 is a section view similar to FIG. 1 illustrating the switch in open circuit position.
Figure 3:
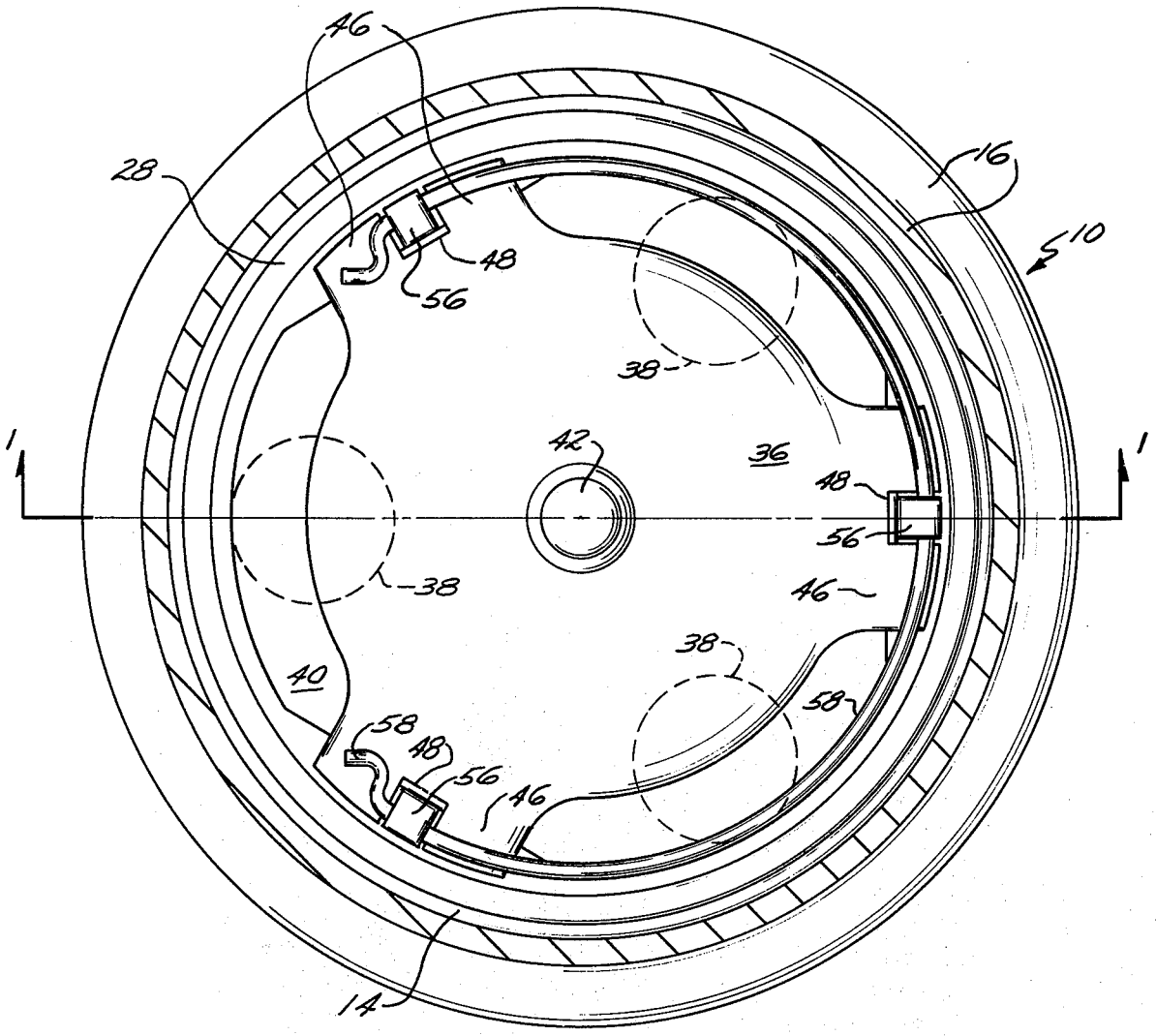
FIG. 3 is a section view along line 3—3 of FIG. 1.

In the switch of this invention, a snap-acting thermostatic disc element 36 is mounted on the header 14 and is associated with movable contacts 38 so that, when the thermostatic element moves in response to selected temperature changes, the movable contacts engage and disengage the fixed contacts 20, thereby to close and open a switch circuit in response to the temperature changes. Preferably for example, the snap-acting disc 36 comprises a generally conventional resilient, electrically conductive, dished bimetallic element 36 (only one layer being shown for clarity of illustration) which has its central part fixedly secured to an electrically conductive metal heater plate 40 of low carbon steel or the like by means of a rivet 42 to form a subassembly 44. Three movable contacts 38 are mounted at the periphery of the heater plate as shown in FIGS. 1 and 2. The thermostatic element 36 has marginal ears 46 which are bifurcated by slots 48 as shown particularly in FIG. 3 and support means 50 are arranged to mount the subassembly 44 so that the disc 36 is permitted to move in response to temperature changes. That is, a spiderlike support 52 has upstanding, peripheral arms 54 which fit into the slots 48 in the disc ears 46 and which have outturned ends 56 as shown in FIGS. 1 and 2. A snap or spring retaining ring 58 fits around the spider arms over the disc ears 46 and under the outturned ends 56 of the spider arms to movably mount the subassembly 44 on the support means 50.

As thus far described, the switch 10 is conventional and is shown in U.S. Pat. No. 3,452,313. In accordance with this invention, the header 14 is provided with a centrally located through-bore 60. Where an insulator 28 is used, the bore 60 is aligned with a corresponding opening 62 in the bottom of the insulator. No tapping or threading of the header bore is required and the bore is easily and economically provided in the header. A corresponding bore 64 is also provided in the central part of the spider support 52. Stud means 66 then fit into those bores for mounting the support means 50 on the header.

That is, the stud means 66 comprises a member having one end 68 of a rivet configuration which is fitted into the bore 64 on the spider support. The stud member has a flange part 70 which bears against the bottom of the spider support and is headed over as at 72 at the opposite side of the support, thereby to fixedly secure the support to the stud member 66 in an economical way. As no relative movement is required between the stud member and the support after riveting, the bore 64 in the support and the rivet configuration provided on the stud do not require any close tolerances and the support and stud are easily joined together.

The stud 66 also includes an intermediate knurled portion 74 of a diameter which is selected relative to the diameter of the header bore 60. Preferably as shown in the drawings, the intermediate part of the stud member is provided with linear knurlings which extend parallel to the axis of the stud member 66. The diameter of the knurled part of the stud is selected so that it will have a secure, interference fit in the header bore 60 as is hereinafter described.

Figure 4:
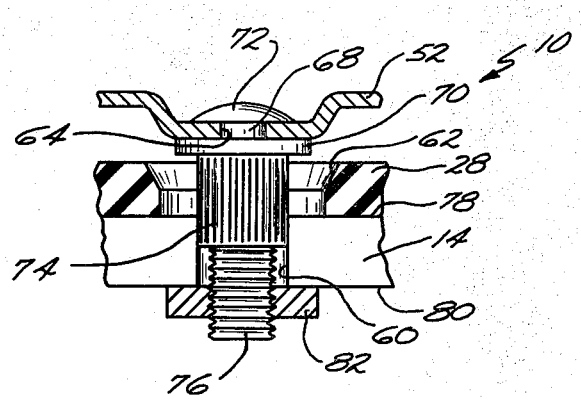
FIG. 4 is a partial section view to enlarged scale similar to FIG. 1 illustrating assembly of the switch.

The stud member 66 also has an opposite end 76 which is threaded, which is of relatively lesser diameter than the knurled stud part 74, and which is of sufficient length to pass through the header bore 60. In assembling the switch 10 as shown in FIG. 4., the threaded end of the stud member is inserted into the header bore from one side 78 of the header so that the subassembly 44 and support means 50 are disposed at that side of the header and so that the threaded end 76 of the stud passes through the header bore 60 to extend from the opposite side 80 of the header. A nut 82 is threadedly engaged with the stud end 76 and bears against the opposite side 80 of the header so that, when the nut is rotated, the knurled part 74 of the stud is drawn part way into the header bore 60. As the knurled stud part is initially drawn into the header bore, its interference fit secures the stud against rotation as the nut is rotated. Thus the stud advances linearly into the header bore without wobbling of the support means 50. The nut rotation provides the necessary force to draw the knurled stud part into the header bore with a secure interference fit in the bore and also permits the knurled stud part to be carefully and precisely advanced within the bore, whereby the support means 50 and subassembly 44 are precisely positioned relative to the header 14 for calibrating the switch 10. That is, the subassembly is drawn down so that the movable contacts 38 of the switch bear against the fixed contacts 20 with a selected force when the switch is in closed circuit position at a first selected temperature as illustrated in FIG. 1 but so that, when the thermostatic disc 36 is at a second, actuating temperature, the disc moves to the position shown in FIG. 2 for opening the switch circuit. Further, when the stud 66 is located in its desired position of adjustment for calibrating, the stud is securely and reliably positioned in the header bore. That is, the interference fit of the knurling on the intermediate stud part prevents rotation of the stud 66 in the header bore and also prevents any further movement of the stud in an axial direction further into the header bore 60. On the other hand, the nut 82 prevents axial movement of the stud member in the opposite direction out of the header bore.

Preferably as shown in the drawings, a cap 27 is welded to the header after the switch has been calibrated as above described, thereby to complete hermetic sealing of the switch compartment 18.

It should be understood that the preferred embodiment of the switch of this invention has been described above by way of illustrating the invention but that the invention includes all modifications and equivalents of the disclosed embodiments which fall within the scope of the appended claims.

I claim:

1. A thermostatic electrical switch comprising fixed contact means; means including a member having a through bore therein supporting the fixed contact means; movable contact means; thermostatic means carrying the movable contact means for moving the movable contact means in response to selected temperature changes; and means mounting the thermostatic means on said member, said mounting means comprising stud means having a portion secured to said thermostatic means, having a portion of selected diameter extending into a selected part of said bore from one side of the member with an interference fit in said part of bore to prevent rotation of the stud means in the bore and to prevent axial movement of the stud means further into the bore from said one side of the member, and having a threaded portion passing through the remainder of said bore to extend from the opposite side of the member, and nut means threadedly engaging said threaded portion of the stud means and bearing against said opposite side of the member to prevent axial movement of the stud means in an opposite direction within said bore, thereby to locate the thermostatic means in a selected position spaced from said one side of the member so that the thermostatic means is adapted to move the movable contact means between an open circuit position spaced from the fixed contact means and a closed circuit position engaged with the fixed contact means in response to said selected temperature changes.

2. A thermostatic electrical switch comprising fixed contact means; a member having a through bore therein supporting the fixed contact means; movable contact means; theremostatic means carrying the movable contact means for moving the movable contact means in response to temperature change; stud means having one end portion secured to said thermostatic means, having an intermediate portion of selected diameter disposed in a selected position extending part way into said bore from one side of the member with an interference fit in said part of the bore to prevent rotation of the stud means in the bore and to prevent axial movement of the stud means further into the bore from said one side of the member for spacing the thermostatic means in a selected location at said one side of the member to move the movable contact means between an open circuit position spaced from the fixed contact means and a closed circuit position engaging the fixed contact means in response to selected temperature changes, and having a threaded, opposite end portion of relatively lesser diameter than said intermediate portion passing through the remainder of said bore to extend from the opposite side of the member; and nut means threadedly engaging the opposite end portion of the stud means and bearing against said opposite side of the member to prevent axial movement of the stud means in an opposite direction within the bore for holding the stud means in said selected position in said bore.

3. A switch as set forth in claim 2 wherein said intermediate portion of said stud means is knurled around its circumference.

4. A switch as set forth in claim 3 wherein the knurlings on said intermediate portion of the stud means extend linearly parallel to the axis of said stud means.

5. A switch as set forth in claim 2 wherein said thermostatic means comprises a snap-acting thermostatic disc element and a support for said disc element and wherein said one end portion of the stud means is of a rivet configuration and is riveted to said support.

6. A thermostatic electrical switch comprising a header having a through bore therein; fixed contact means mounted on the header; a heater plate; movable contact means mounted on the heater plate; thermostatic means secured to the heater plate; a support for the thermostatic means permitting the thermostatic means to move the movable contact means in response to temperature changes; stud means having one end with integral rivet means thereon riveted to said support, having a knurled intermediate portion of selected diameter disposed in a selected position extending part way into said header bore with an interference fit in said part of the bore to prevent rotation of the stud means in the bore and to prevent axial movement of the stud means further into the bore from said one side of the member for disposing the thermostatic means in a selected location at said one side of the header to move the movable contact means between an open circuit position spaced from the fixed contact means and a closed circuit position engaging the fixed contact means in response to selected temperature changes, and having a threaded opposite end passing through the remainder of the header bore to extend from the opposite side of the header; and a nut threadedly engaging the threaded opposite end of the stud means and bearing against said opposite side of the header to prevent axial movement of the stud means in an opposite direction within the bore for holding the stud means in said selected position in the bore.

* * * * *